United States Patent [19]

Jensen

[11] 4,349,147

[45] Sep. 14, 1982

[54] TRAY WITH INTEGRAL LOCKING TAB

[75] Inventor: James R. Jensen, Fremont, Calif.

[73] Assignee: Container Corporation of America, Chicago, Ill.

[21] Appl. No.: 245,055

[22] Filed: Mar. 19, 1981

[51] Int. Cl.[3] ..... B65D 5/22

[52] U.S. Cl. ..... 229/34 R; 229/35

[58] Field of Search ..... 229/34 R, 35

[56] References Cited

U.S. PATENT DOCUMENTS

| | | | |
|---|---|---|---|
| 2,637,484 | 5/1953 | Buttery | 229/34 R |
| 2,779,526 | 1/1957 | Vogt | 229/34 R |
| 2,918,205 | 12/1959 | Zeitter | 229/45 |
| 3,520,468 | 7/1970 | Wiemann | 229/34 R |
| 4,134,533 | 1/1979 | Heanner | 229/34 R |

FOREIGN PATENT DOCUMENTS

| | | | |
|---|---|---|---|
| 737685 | 9/1955 | United Kingdom | 229/35 |

*Primary Examiner*—Herbert F. Ross

*Attorney, Agent, or Firm*—Richard W. Carpenter; Davis Chin

[57] ABSTRACT

A tray formed of a unitary blank of foldable paperboard for storing food articles such as mushrooms and the like includes a locking tab formed in the side flaps for interengaging a related gate flap disposed in the side walls of the tray. A stacking tab is also formed in the side flaps joined integrally to a partial top cover panel.

2 Claims, 5 Drawing Figures

TRAY WITH INTEGRAL LOCKING TAB

BACKGROUND OF THE INVENTION

1. Field of the Invention

This invention relates generally to containers and more particularly, it relates to a tray for storing food articles such as mushrooms. The present tray has a locking tab formed in side flaps for interengaging a related gate flap disposed in the side walls of the tray and a stacking tab formed in the side flaps joined integrally to a partial top cover panel.

2. Description of the Prior Art

The prior art appears to be best exemplified in the following patents which were developed in a search directed to the subject matter of this application: U.S. Pat. Nos. 454,636; 783,806; 2,120,470; 2,590,371; 2,660,634; 2,721,689; 2,918,205; 3,871,570; 4,134,533 and 4,139,146.

None of the prior art uncovered in the search disclosed a tray like that of the present invention which provides a locking tab formed in side flaps for interengaging a related gate flap disposed in the side walls of the tray. A stacking tab is also formed in the side flaps joined integrally to a partial top cover panel.

SUMMARY OF THE INVENTION

Accordingly, it is a general object of the present invention to provide a new and improved tray formed of a unitary blank of foldable paperboard for storing food articles such as mushrooms and the like.

It is the object of the present invention to provide a tray having interlocking means formed on side flaps and related side walls for maintaining cover panels in a closed position.

It is another object of the present invention to provide a tray which includes interlocking means consisting of a locking tab formed on each of the side flaps and a pair of gate flaps disposed on respective ends of the side walls.

It is still another object of the present invention to provide a tray of the type described which includes stacking tabs formed on the side flaps so as to facilitate nesting with other similar trays.

BRIEF DESCRIPTION OF THE DRAWINGS

These and other objects and advantages of the present invention will become more fully apparent from the following detailed description when read in conjunction with the accompanying drawings wherein.

DESCRIPTION OF THE PREFERRED EMBODIMENT

Figure 1:
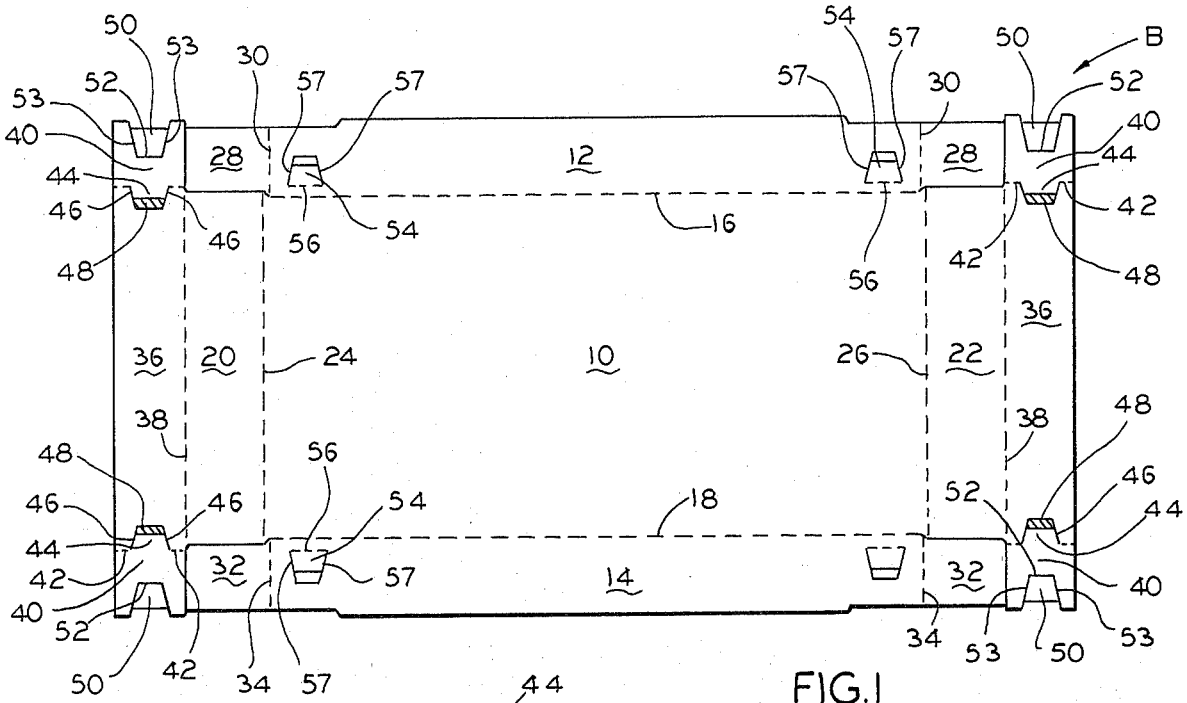
FIG. 1 is a plan view of an unfolded blank which is cut and scored for forming the tray in accordance with the present invention.
Figure 2:
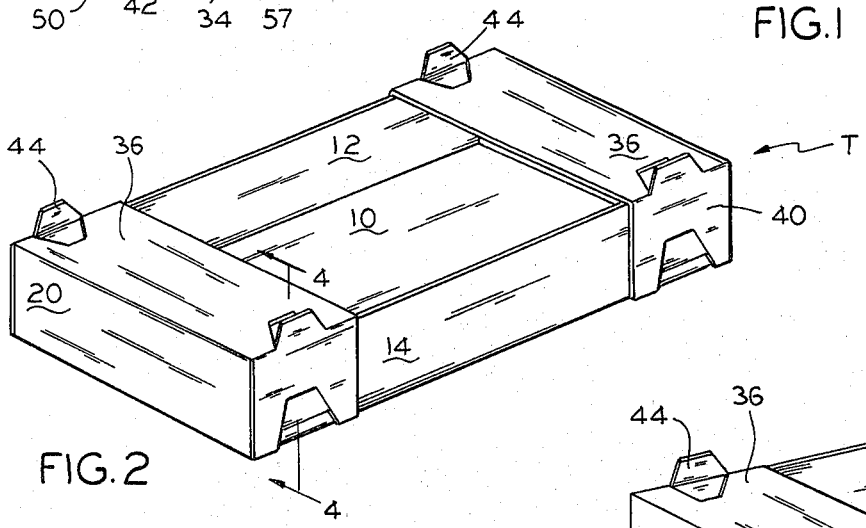
FIG. 2 is a perspective view of the tray embodying the present invention.

Referring now in general to the drawings, there is shown in FIG. 1 a unitary blank B of foldable paperboard which is cut and scored and can be folded to form the new and improved tray T of the present invention illustrated in FIG. 2. The tray T is utilized for storing food articles such as mushrooms and the like. The blank B comprises a bottom wall panel 10 having a pair of opposed side wall panels 12, 14 hingedly attached to the bottom panel 10 along respective fold lines 16, 18. A pair of opposed end wall panels 20, 22 are hingedly attached to the bottom panel 10 along respective fold lines 24, 26. The side panel 12 is provided with a pair of opposed corner flaps 28 connected by fold lines 30 and in a similar fashion, the side panel 14 is provided with a pair of opposed corner flaps 32 joined by fold lines 34. In the erect condition, the corner flaps 28, 32 are folded inwardly so as to lie adjacent the inside surfaces of the related end panels 20, 22.

A cover or partial cover is provided in the form of a pair of top cover panels 36 which are foldably joined along fold lines 38 to the upper edges of the opposed end panels 20, 22. The cover panels 36 are adapted to be folded inwardly and downwardly at right angles to the end panels 20, 22 with their end edges supported by the opposed side wall panels 12, 14 of the tray. Each of the cover panels 36 are provided at its opposite ends thereof with a side flap 40 which is foldably joined to the cover panel along interrupted fold lines 42. Each of the side flaps 40 has a stacking tab 44 which is formed from material cut from the related cover panel along cut lines 46. It is to be noted that the stacking tab 44 is separated from the related cover panel by a cut-out portion 48.

The present invention includes an interlocking means formed in the lower portions of the side flaps 40 and side wall panels 12, 14 comprising a plurality of locking tabs 50 and a plurality of co-acting gating flaps 54 as can best be seen in FIG. 1. The locking tabs 50 formed on the side flaps 40 are hinged thereto along fold lines 52 and are separated from the related side flap 40 by cut lines 53. The gating flaps 54 formed on the side panels 12, 14 are defined by fold lines 56 and cut lines 57.

Figure 3:
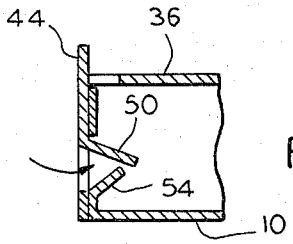
FIG. 3 is a fragmentary view showing the locking flap being passed through the opening to displace the gate flap.
Figure 4:
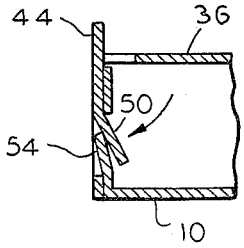
FIG. 4 is a fragmentary view showing the gate flap being returned to its original position for maintaining in place the locking flap.

In order to form the tray of FIG. 2, the side walls 12 and 14, corner flaps 28, end wall panels 22, cover panels 36 and side flaps 40 are all suitably folded for functioningly interengaging the locking means. The locking tab 50 is initially pushed inwardly to be deflected past the gating flap 54 as illustrated in FIG. 3. As the gating flap 54 returns to its original position, the locking tab 50 is maintained inside of the tray so as to form an interlock as can be seen in FIG. 4.

Figure 5:
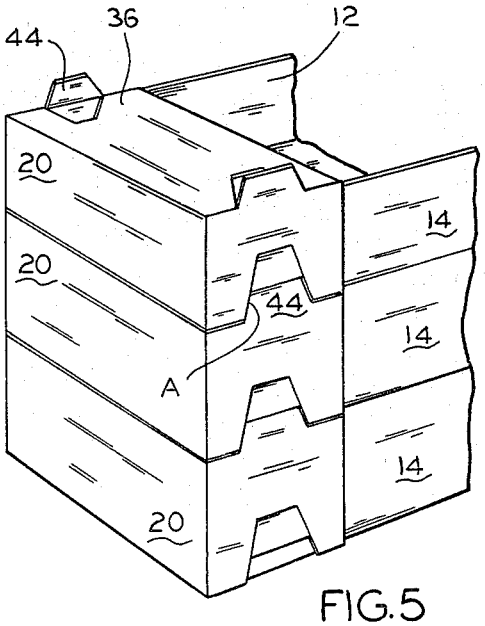
FIG. 5 is a perspective view illustrating the manner in which a plurality of trays of FIG. 2 can be stacked one atop of another.

When a plurality of similar trays embodying the invention are stacked vertically one atop of another as shown in FIG. 5, the stacking tabs 44 of a lower tray is adapted to be received within the area A adjacent the interlocking flaps 50, 54 in the related upper tray.

While there has been illustrated and described what is at present to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out this invention, but that the invention will include all embodiments falling within the scope of the appended claims.

What is claimed is:

1. A tray formed of a unitary blank of foldable paperboard for storing food articles such as mushrooms and the like, said tray comprising:

a bottom wall;

a pair of opposed side walls foldably joined to and upstanding from opposed side edges of said bottom wall;

a pair of opposed end walls foldably joined to and upstanding from opposed end edges of said bottom wall;

a pair of corner flaps foldably joined to opposed ends of said pair of opposed side walls and being turned inwardly to lie adjacent to the inside surfaces of respective end walls;

top cover panels foldably joined to upper edges of respective end walls and folded inwardly and downwardly to close at least a portion of the tray;

side flaps connected to opposed ends of said top cover panels and folded downwardly in face-to-face relation with the outer surfaces of said side walls;

interlocking means formed on said side flaps and said side walls for maintaining said cover panels in a closed position; and said interlocking means including a locking tab disposed on each of said side flaps and a pair of gating flaps disposed on respective ends of said side walls, said locking tabs being adapted to be pushed inwardly so as to be deflected past said gating flap and said locking tab being retained inside of the tray and in contact with the inside surface of said gating flap when said gating flap returns to its original position.

2. A tray as claimed in claim 1, wherein said side flaps include stacking tabs which project upwardly therefrom and are adapted to be received within the area adjacent said interlocking means of a similar tray disposed thereabove when the trays are stacked.

* * * * *